US005409137A

United States Patent [19]

Bonomelli

[11] Patent Number: 5,409,137

[45] Date of Patent: Apr. 25, 1995

[54] VOLUMETRIC BATCHER, PARTICULARLY FOR CHAMOMILE FLOWERS TO BE PACKED IN FILTER-BAGS

[75] Inventor: Federico Bonomelli, Dolzago, Italy

[73] Assignee: Bonomelli S.R.L., Bologna, Italy

[21] Appl. No.: 140,069

[22] Filed: Oct. 28, 1993

[30] Foreign Application Priority Data

May 22, 1991 [IT] Italy ..... MI91A1402

[51] Int. Cl.[6] ..... B67D 5/08

[52] U.S. Cl. ..... 222/56; 222/63; 222/217; 222/235; 222/333; 222/361

[58] Field of Search ..... 222/56, 63, 64, 233, 222/235, 330, 333, 216, 217, 221, 361

[56] References Cited

U.S. PATENT DOCUMENTS

| | | | |
|---|---|---|---|
| 3,330,311 | 7/1967 | Christine et al. . | |
| 3,461,820 | 8/1969 | Falco | 222/361 X |
| 4,629,093 | 12/1986 | LeMolaire | 222/361 X |
| 5,092,490 | 3/1992 | Suzuki et al. | 222/56 |

FOREIGN PATENT DOCUMENTS

| | | | |
|---|---|---|---|
| 0270814 | 6/1988 | European Pat. Off. . | |
| 2269064 | 11/1975 | France . | |
| 220287 | 1/1909 | Germany . | |
| 325063 | 2/1930 | United Kingdom | 222/216 |

*Primary Examiner*—Gregory L. Huson

*Attorney, Agent, or Firm*—Panitch Schwartze Jacobs & Nadel

[57] ABSTRACT

An improved volumetric batcher particularly suitable for a dosed feeding of a dishomogeneous and scarcely slidable as well as extremely fragile product, such as chamomile flowers, to be introduced in filter-bags. Several batching units placed side by side, provide operation with high-speed packing machines. Fed by a single container is the bottom of the container screw-feeders are provided to push the product in to a corresponding vertical loading conduit. A pneumatic piston in the loading conduit compress to a product in the batching chamber which is aligned with a hole passing through a fixed plate which supports the batcher. The batching chamber is located inside a mobile second plate of the batcher. When the second plate is in a loading position, the batching chamber is aligned with the hole and the loading circuit and in as opposed discharging position, the batching chamber is aligned with a second hole is the fixed supporting first plate, which hole serves for the passage of an ejecting piston, and a discharging hole of a fixed underlying third plate of the batcher.

15 Claims, 1 Drawing Sheet

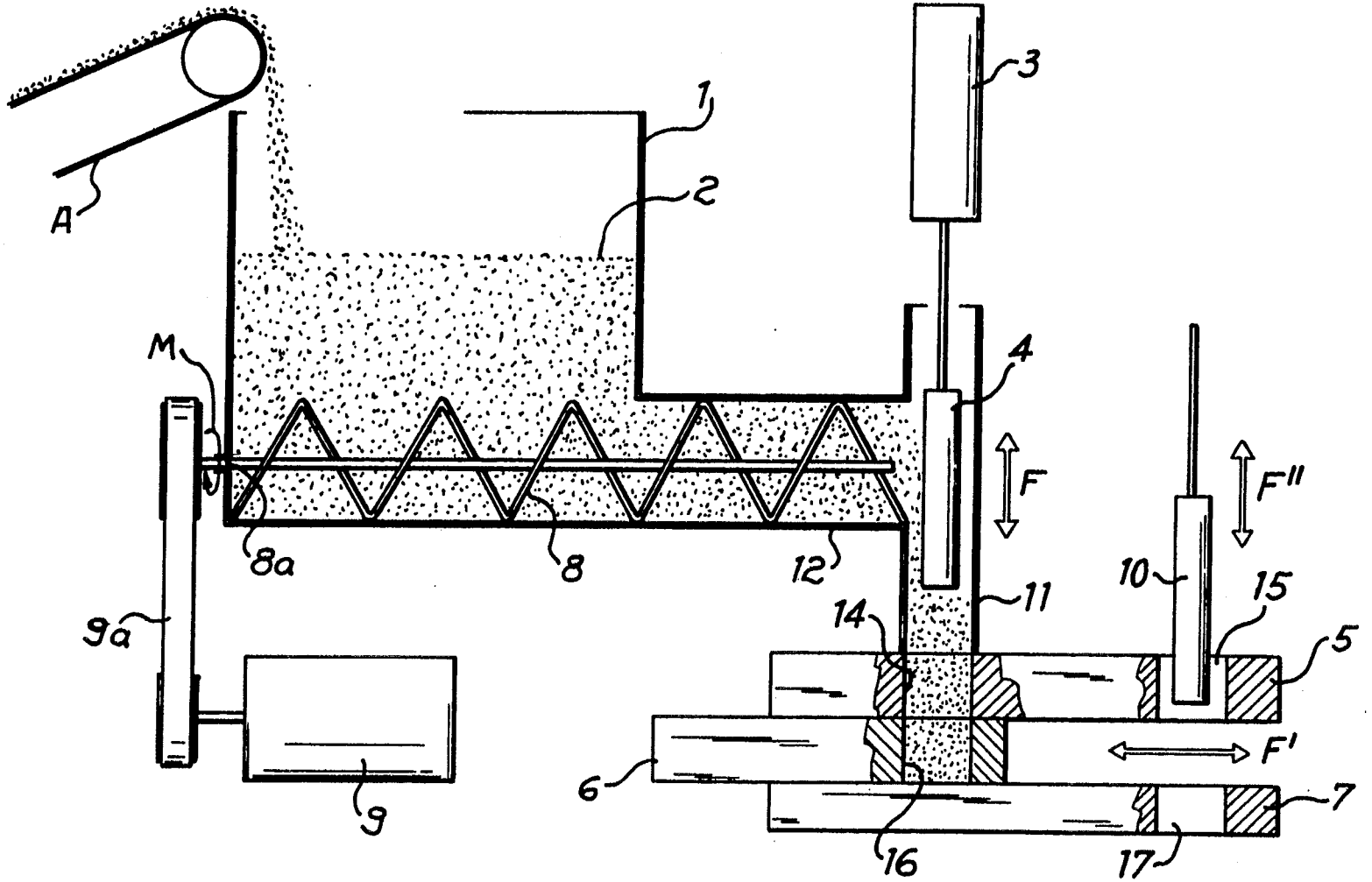
1
2
3
4
5
6
7
8
8a
9
9a
10
11
12
14
15
16
17
F
F'
F''
M
A

VOLUMETRIC BATCHER, PARTICULARLY FOR CHAMOMILE FLOWERS TO BE PACKED IN FILTER-BAGS

FIELD OF THE INVENTION

The present invention relates to an improved volumetric batcher, particularly for chamomile flowers.

BACKGROUND OF THE INVENTION

It is known to pack products for infusions, such as tea, chamomile and the like, inside filter-bags. Recently there has increased and gained favour among the consumers a product called "filtro-fiore" in Italian (flower-filter in English), consisting of almost integral chamomile flowers which are packed, as much as possible intact to merit such a name.

This product is per se scarcely slidable, extremely fragile and dishomogeneous, as the various parts which compose a chamomile flower, and comprise the product, have physical characteristics, particle size and specific weight which are considerably different from each other.

Up to now a batcher designed by the same applicant has been adopted for the dosed filling of filter-bags in a packing machine of known type, which batcher proved to be relatively sufficient as far as both the quality of the product and the protection of the physical aspect thereof are concerned. The batcher is of the volumetric type, as it is not conceivable to employ batchers on a ponderal basis, each dosing being about 2 g in weight and the relative weighing having to occur at a rhythm of about 100 times per minute, with minimum deviations percent and therefore negligible ones in absolute value.

In the known batchers it was possible to overcome the problem of unreliable batcher filling, thus avoiding the so called "bridges" of material, due to both the dishomogeneity of the product and the dimensions thereof, and taken into account that a bud of chamomile with its stalk can have an overall length of $3 \div 3.5$ cm, thus involving, as a result of its arrangement, problems in filling the batcher with more product due to blockage of the passage. The problem was solved by adopting a mobile batching chamber inside which the filling takes place by a free fall of the product and a successive compression thereof by means of a pad actuated by a pneumatic cylinder. Such a batching chamber is formed in a mobile plate and is closed at its bottom by a small door which is adjustable in height to change the dose volume and can be opened each time for discharging the product. The batcher consists of both said mobile plate and a fixed supporting one which has a through hole with the same size of the batching chamber. When the latter is aligned with said through hole of the fixed plate, which hole is arranged coaxially with the vertical of a loading conduit through which said compressing pad slides, there occurs the filling of the batching chamber. The following stroke of the mobile plate, causes the clean cut of a core of product, due to the sliding of the upper edges of the batching chamber against the lower surface of the fixed plate above, while the upper surface of the mobile plate prevents the product from falling from both the loading conduit and the through hole of the fixed plate. The small door opens near the end of a stroke of the mobile plate, with consequent falling down of dosed product in a filter-bag below, which is submitted by the packing machine. The vertical loading conduit communicates with a hopper, which is continuously fed by a reservoir through a screw-feeder which, by drawing therefrom, raises the product up to the upper edge of said hopper, while anyhow needing additional means such as spirals at its sides, to overcome the difficulties of drawing due to the scarce smoothness of the product, but with the consequence of some damages to the integrity of the product itself.

In spite of the merits of the above briefly described device, the most considerable limit thereof remains a limited productivity, as it has a filling rate of about 100 filter-bags per minute. It has been found that, for rates higher than 110 cycles per minute, the gravity fall just after the opening of the small door with a slight advance with respect to the forming of a filter-bag, involves different fall times, mainly due to the dishomogeneity of each component. Thus it is not possible to increase the working rate of the batcher to have it coincident with the working rate of faster packing machines which theoretically could ensure a higher productivity.

Also the experimented hypothesis of employing a carousel of small containers placed between the batchers and a single packing station was found to be not practicable as, by using N intermediate containers, the batchers rate would positively be 1/N of the machine rate, but the transfer of the dose to the carousel and therefrom to a filling area, would have to take place in a very short time, less than $1/(N \times 100)$. The limit seems to be mainly due to the free fall of the product.

Thus an improved batching device has been conceived and forms the object of the present invention, which does not show the above mentioned drawbacks, as it has a filling rate which is, on the whole, higher and adequate to the working rate of already existing packing machines which are suitable to work at the same time, with high productivity, at many stations for filter-bags filling, without proportionally increasing the batcher working rate.

SUMMARY OF THE INVENTION

This is obtained by a device comprising a reservoir upstream of a dispensing unit with a substantially vertical loading conduit inside which a compressing pad shifts lengthwise in two opposite directions, coaxially with a hole of a stationary supporting first plate below which, while remaining always in contact therewith, a plate shifts horizontally, a batching chamber being formed therein, and means being provided to keep closed the bottom of the latter up to a discharging position of said plate, and comprising as well several dispensing units each of them fed by said reservoir through a screw-feeder arranged substantially horizontal at the bottom of said reservoir with its terminal part housed inside a conveying conduit which branches off, in parallel to other conduits, from said reservoir, each of them being communicating with the respective conduit, wherein moreover said means for closing the bottom of the batching chamber consists of a second stationary plate arranged below said mobile plate and in direct contact therewith, which has a through hole in its discharging area, coaxial to and having the same transversal dimensions of a second hole in said first plate.

It should be noted that the size of the reservoir, a single one for all the units, allows to employ, for the feeding thereof, an element like a conveyor-belt without needing a lifting screw-feeder, thus eliminating the above mentioned drawbacks which derive from employing spirals which ensure the drawing of the screw-feeder itself. In fact the screw-feeders employed in this case for pushing the product towards each loading conduit, are completely immersed in the mass of product, as they are arranged at the container bottom, so that the above cited problems of drawing do not occur, also because the screw-feeders operate horizontally and do not to convey the product upwards.

According to a particular aspect of the present invention, each screw-feeder is actuated independently by a motor combined thereto, through a varying torque such to fill in a controlled way the loading conduit, as a function of the consumption and depending on the desired degree of compression. The latter feature is controlled by adjusting the force exerted by the compressing pad inside the discharging conduit. In such a way, by varying the product density, more or less compressed, the weight of each dose can be changed in a completely independent way.

Another advantage one a single batcher according to the prior art, is the absence of mechanical elements at the discharge of the product, such as the small door which had to open in advance with respect to reaching the filling station, with consequent possibility of approaching the final container of the dosed quantity.

BRIEF DESCRIPTION OF THE DRAWINGS

These and other aims, advantages and characteristics of the batching device according to the present invention will be more clear from the following detailed description of a preferred embodiment thereof, given as a non-limiting example with reference to the sole drawing attached, which shows a sectional diagrammatic view of a single batching unit.

DESCRIPTION OF THE PREFERRED EMBODIMENT

With reference to the drawing, one of the batching units forming the device according to the present invention is diagrammatically represented in section, connected, as well as other units not visible in the drawing, to a common container 1 for receiving a product, such as chamomile through a conveying conduit 12. From the container 1 itself other conveyors 12 branch off, in particular three in a battery of four batching units, branch off parallel to each other. The container 1 receives the product, in particular formed of whole chamomile flowers, as above specified, but possibly also of a different type of product having similar characteristics, by means of a conveyor-belt A. The feeding through the belt A is such that in the container 1 a level 2 is kept as much as possible constant by means of a sensor suitable to control the number of revolutions of an actuating motor of the belt.

At the bottom of container 1, in correspondence with each conveying conduit 12, a screw-feeder 8 is provided. The total number of screw-feeder 8 is equal to the number of the batching units, which are substantially parallel to each other. The screw-feeder directly contacts the product discharged by the conveyor-belt, at the bottom of container 1, to prevent the forming of "bridges" and empty pockets, inside the container. Each screw-feeder, actuated independently by a motor 9, pushes the product through the conduit 12 into a vertical loading conduit 11 associated therewith. The pressure exerted on the product, and then the compression thereof inside the passage 12, depends on the adjustable torque or twisting moment exerted by the motor 9. Additionally, the degree of compression inside the conduit 11 is also a function of the force by which a pad 4 is pushed downwards. The pad four is actuated by either a hydraulic or pneumatic cylinder.

The batching unit further comprises three plates 5, 6, 7 overlapped to each other. The upper plate 5 and the lower plate 7 are stationary, and the middle plate 6 is mobile. The plate 5 works as an element for both supporting and cutting a core of product. Plate 6 is the mobile element of the batcher, and the batching chamber 16 is obtained therein. In other words, the thickness of plate 6 determines the height of the cylinder or core of product obtainable at each dosing. The volume of each dose is therefore constant, not variable as it was with the above described known apparatus. In the following it will be described how to obtain the control of the quantity of product at each batch, while keeping constant the batching chamber volume.

The plate 5 has a through hole 14 coaxial to and having the same cross-section as the loading conduit 11, as well as a second through hole 15 located in an area for ejecting the product. A pad 10 vertically actuated along two opposite directions (double arrow F″) by a means (not represented) such as a pneumatic cylinder or a kinematic mechanism, preferably synchronous with the packing machine, can pass through the whole hole 15 until reaching, in correspondence with the lower stroke-end, a point below plate 5. The plate 6 is transversally mobile in two opposite directions, as shown by the arrow F′, between the two fixed plates 5 and 7, from a feeding position, as represented in the figure, in which the batching chamber 16 is aligned with the hole 14 and the loading conduit 11, to an opposed discharging position in which said chamber 16 is aligned with the hole 15. The lower plate 7 has a hole 17 coaxial to and having the same cross-section as the hole 15, which is coaxial with the dispensing chamber 16, when the dispensing chamber is in the discharging position. In addition, the hole 17 has the same cross-section as the hole 15.

As already mentioned above, each screw-feeder 8 is preferably actuated by a single motor 9 controlled independently from each other such to vary its output torque and therefore the applied twisting moment M, through the transmission parts 9*a*, along axis 8*a* of the screw-feeder 8, causes a variation of the product density, especially inside the conveying conduit 12. This provides a first regulation of the product density. Product density is also regulated by pad 4, which is mobile along the two directions shown by the double arrow F inside the loading conduit 11. By suitably operating on the actuating part 3 of the pad 4, the compression can be increased or decreased, and therefore the density, inside the loading conduit can be adjusted. Thus, inside the dispensing chamber more product or less can be contained at will, depending on the need. It should be noted that, differently from the previously known dispenser, in which only the piston compressed the product, otherwise soft, to fill the batching chamber, now a return of the pad to the initial position thereof before forward movement of plate 6 causes a core of product to be cut, does not undo the compressing effect of the pressure exerted upstream of the screw-feeder.

The working of the device according to the invention, as it clearly results from the above description, is now described. The product, in particular chamomile in whole flowers, coming from previous operations, is fed by any known way, but anyhow freely and without mechanic mistreatments, on a lifter-conveyor belt. The product then falls down by gravity from the conveyor belt into a reservoir 1 common to all the batching units and therefore having a sufficiently wide cross-section, as above said. The flow of product supplied by the belt A is controlled so as to keep a certain level 2 inside reservoir 1. The various screw-feeders are actuated to push the product through the conveying passages 12 and then in the loading conduits 11 from which, by the pressure exerted by the corresponding pads 4, through the holes 14 the chambers 16 of each dispensing unit are filled with a suitable density to have the desired weight, while taking into account the fixed predetermined volume of the chamber itself. Once the latter is filled, plate 6 approaches the discharging area (right direction of the arrow F') and the pad 4 raises. When the chamber 16 reaches a position coaxial to both holes 15 and 17, the contents thereof are ejected under the plate 7 through a downwards thrust exerted by the piston 10. This action takes place contemporaneously for all the batching units, so as to work in synchronism with the packing machine which, in the meanwhile, has submitted the filter-bags, ready to receive the product, under the various holes 17 of all the units. Finally, it will be appreciated that any number of batching units can be provided, depending on the employed packing machine. Further, the screw-feeders 8, and the passages 12, could be non-parallel to each other but arranged, for instance, in a dial surrounding the reservoir 1.

I claim:

1. A volumetric batcher, in particular for chamomile flowers to be packed in filter-bags, comprising:

a reservoir;

a dispensing unit having a substantially vertical loading conduit, the reservoir being located upstream of the dispensing unit;

a compressing pad shiftable lengthwise in two opposite directions;

a stationary supporting first plate having a first hole therein, the compressing pad shifting coaxially into the first hole;

a mobile plate in contact with the first plate shiftable horizontally having a batching chamber formed therein;

means for closing a bottom of the batching chamber;

a screw-feeder arranged substantially horizontal to and located at a bottom of the reservoir having a terminal part housed inside a conveying conduit, the conveying conduit extending from the reservoir to the loading conduit, the screw-feeder communicating with the conveying conduit wherein the means for closing the bottom of the batching chamber includes a second stationary plate arranged below the mobile plate and in direct contact therewith, the second stationary plate having a discharging area with a through hole therein, the through hole being coaxial to a second hole in the stationary supporting first plate, the through hole and the second hole having substantially similar transversal dimensions.

2. A batcher according to claim 1, characterized in that the screw-feeder is actuated by an independently controlled associate motor.

3. A batcher according to claim 1, wherein the compressing pad is actuated by a bidirectional motor.

4. A batcher according to claim 1, further comprising a second compressing pad which is axially shiftable with a bidirectional actuation, for ejecting product contained in said batching chamber when said batching chamber is aligned with said through hole and said second hole.

5. A batcher according to claim 1 further comprising a conveyor-belt for continuously feeding product to said reservoir.

6. A batcher according to claim 5 further comprising an actuating motor for actuating said conveyor belt wherein the number of revolutions of the actuating motor is controlled by a sensor for maintaining a predetermined level of product inside said reservoir.

7. A batcher according to claim 1, characterized in that said batching chamber has a cross-section equal to a cross-section of said first hole, said second hole, and said through hole.

8. A batcher according to claim 1, characterized in that a stroke of said mobile plate from a loading position to a discharging position causes cutting of a small cylinder of product, said cylinder having a height equal to a height of the batching chamber.

9. A batcher according to claim 2, wherein the compressing pad is actuated by a bidirectional motor.

10. A volumetric batcher for packing chamomile flowers or a similar product in filter-bags, comprising:

a reservoir for receiving the product, the reservoir having a conveying conduit located at a bottom thereof;

a vertical loading conduit in communication with the conveying conduit;

a screw feeder at the bottom of the reservoir for moving the product from the reservoir through the conveying conduit into the loading conduit;

a batching unit for providing a predetermined dosage of the product; and a compression pad shiftable within the loading conduit for feeding the product into the batching unit.

11. The volumetric batcher of claim 10 wherein the batching unit comprises:

a first stationary plate having a first through hole coaxial with the loading conduit and of substantially similar transversal dimensions as the loading conduit and a second through hole located at an area for ejecting the product from the batching unit;

a second stationary plate having a through hole formed therein, the through hole being coaxial with the first plate second through hole;

a mobile plate located between the first and second stationary plates, the mobile plate having a batching chamber located therein, the mobile plate being movable between a feeding position wherein the batching chamber is aligned with the first through hole and a discharging position wherein the batching chamber is aligned with the second through hole; and a second compression pad shiftable into the second through hole for moving the product from the batching chamber to the second stationary plate through hole.

12. The volumetric batcher of claim 11 wherein a height of the mobile plate determines a volume of product per dosage.

13. The volumetric batcher of claim 10 further comprising a motor for actuating the screw feeder.

14. The volumetric batcher of claim 10 further comprising an actuator for moving the compression pad.

15. The volumetric batcher of claim 10 further comprising a conveyor belt for loading the product into the reservoir.

* * * * *